US006075407A

United States Patent [19]

Doyle

[11] Patent Number: 6,075,407

[45] Date of Patent: Jun. 13, 2000

[54] LOW POWER DIGITAL CMOS COMPATIBLE BANDGAP REFERENCE

[75] Inventor: James T. Doyle, Chandler, Ariz.

[73] Assignee: Intel Corporation, Santa Clara, Calif.

[21] Appl. No.: 08/808,187

[22] Filed: Feb. 28, 1997

[51] Int. Cl.[7] ..... G05F 1/10

[52] U.S. Cl. ..... 327/539; 327/541; 323/316

[58] Field of Search ..... 327/539, 540, 327/541; 323/316

[56] References Cited

U.S. PATENT DOCUMENTS

| | | | |
|---|---|---|---|
| 4,399,399 | 8/1983 | Joseph | 323/315 |
| 5,087,830 | 2/1992 | Cave et al. | 327/539 |
| 5,528,128 | 6/1996 | Melse | 323/313 |
| 5,541,551 | 7/1996 | Brehner et al. | 327/539 |
| 5,629,611 | 5/1997 | McIntyre | 323/313 |
| 5,646,518 | 7/1997 | Lakshmikumar et al. | 323/316 |
| 5,680,037 | 10/1997 | Carobolante | 323/315 |
| 5,751,142 | 5/1998 | Dosho et al. | 323/316 |
| 5,796,244 | 8/1998 | Chen et al. | 323/313 |
| 5,900,773 | 5/1999 | Susak | 327/539 |

OTHER PUBLICATIONS

*CMOS Analog Circuit Design* by Phillip E. Allen and Douglas R. Holberg, Oxford University Press (1987), Chapter 11, pp. 589–599.

*The Best of Analog Dialogue*, 25th Anniversary Bonus Edition (1991), pp. 71–72.

*Primary Examiner*—Terry D. Cunningham

*Attorney, Agent, or Firm*—Blakely, Sokoloff, Taylor & Zafman LLP

[57] ABSTRACT

An improved bandgap reference circuit that uses ratioed current mirrors to provide loop gain and minimize the offset sensitivity of the loop amplifier. Furthermore, the combination of both current and diode area ratioing provides a larger effective $\Delta V_{be}$ which in turn reduces circuit sensitivities to resistor ratio values. The circuit features a high gain folded cascode amplifier for fast response, and stable start-up and power down modes. The circuit design required no trims, calibrations, or adjustments using a standard submicron digital CMOS fabrication process, and achieved a simulated reference output level with less than 1% drift over time, temperature, and process variations.

15 Claims, 9 Drawing Sheets

300

LOW POWER DIGITAL CMOS COMPATIBLE BANDGAP REFERENCE

BACKGROUND

This invention relates generally to circuits and devices that produce a precise DC signal, and more specifically to temperature compensated bandgap reference circuits.

Virtually all systems that manipulate analog, digital, or mixed signals, such as Analog-to-Digital and Digital-to-Analog converters, rely on at least one reference voltage as a starting point for all other operations in the system. Not only must a reference voltage be reproducible every time the circuit is powered up, the reference voltage must remain relatively unchanged with process variations and variations in temperature and supply voltage.

A conventional technique for realizing a reference voltage is the semiconductor bandgap reference circuit (also known as a bandgap reference). A bandgap reference relies on the bandgap energy of the underlying semiconductor material. Though varying with temperature, the bandgap energy is a physical constant when extrapolated to a temperature of zero Kelvin (absolute zero). For silicon, the bandgap energy at absolute zero is approximately 1.12 electron Volts. An additional contribution (3 kT/q) to the bandgap energy due to thermal energy at non-zero temperatures raises the bandgap value of silicon to approximately 1.20 electron Volts.

A practical way of obtaining the bandgap energy of silicon is to measure the voltage across a forward biased semiconductor p-n junction (diode) device. Although loosely referred to here as a diode, other devices such as transistors are also typically used to obtain the necessary p-n junction. Thus, p-n junctions appearing in different devices are commonly used to take advantage of the characteristics of the bandgap energy as a physical constant in order to generate DC reference levels.

To help understand how a precise and temperature invariant reference signal can be generated using the bandgap energy characteristics, FIG. 1 illustrates a plot of the voltage drop across a forward biased diode versus temperature for two diodes having different geometries, corresponding to lines 101 and 105. A key aspect of both plots is that the voltage (and hence the bandgap energy) decreases with increasing temperature of the semiconductor material, thus exhibiting a so-called negative temperature coefficient of typically 3000 parts per million (ppm). A cross-sectionally larger diode generates a smaller voltage drop at equal temperature and current, so that line 101 (corresponding to the larger p-n junction) is steeper than line 105 (corresponding to the smaller p-n junction). However, regardless of their slopes, lines 101 and 105 converge at the bandgap value for silicon of 1.12 electron Volts when extrapolated to zero degrees Kelvin. These aspects of the diode voltage allow the following useful equation to be written:

$$V_{bg}=V_{d1}+A(\Delta V_{d1,2}) \quad (1\text{-}1)$$

where $V_{bg}$ is, in all but the most sensitive applications, considered a constant approximated by the bandgap value of silicon in electron Volts, A is a gain factor to be determined, $V_{d1}$ is the voltage drop across a first (smaller) forward biased diode and $\Delta V_{d1,2}$ is the difference between the voltage drops across the first and second diodes such that $\Delta V_{d1,2}$ has a positive temperature coefficient.

The equation (1-1) above shows that as the diode voltages vary with temperature, their weighted sum, equal to $V_{bg}$, is a constant (once a correct value for the constant gain factor A has been selected). This occurs because the positive temperature coefficient of $\Delta V_{d1,2}$ offsets the negative temperature coefficient of $V_{d1}$. $V_{bg}$ is thus the desired reference signal.

To compute A, the voltage for the smaller diode (which incidentally has a higher forward voltage drop than the larger diode when equal currents are applied) may be conventionally approximated as $V_{d1}=(kT/q)\ln(I/I_s)$, such that $$\Delta V_{d1,2}=V_{d1}-V_{d2}=(kT/q)[ln(I_1/I_{s1})-ln(I_2/I_{s2})]$$

where $I_{s1}$ is the reverse saturation current for a diode. Typically, a circuit realization of (1-1) will force the currents $I_1$ and $I_2$ to be approximately the same. This yields $$\Delta V_{d1,2}=(kT/q)ln(I_{s2}/I_{s1}) \quad (1\text{-}2)$$

Since $I_s$ is proportional to the cross-sectional area of the diode, and since the device physics for manufactured diode junctions is well understood such that their voltage versus temperature behavior is predictable, a value for A can be readily computed from (1-1) and (1-2) given an operating temperature, the ratio of the diode areas, a typically known value for diode voltage $V_{d1}$ or $V_{d2}$ at the given temperature, and the desired bandgap reference output $V_{bg}$=1.20 volts.

A conventional bandgap reference circuit 200 based on equations (1-1) and (1-2) is illustrated in FIG. 2. The circuit 200 basically operates as a feedback control loop to maintain the two input nodes of amplifier 217 at approximately the same potential in the steady state. The circuit elements are now described using an exemplary set of assumptions to simplify the mathematics.

Amplifier 217 may be a conventional operational amplifier with very large open loop gain, such that the voltages at two input nodes are assumed to be the same after closing the feedback control loop and in the steady state. According to conventional practice, the currents in the two diodes are assumed to be the same, and $R_2$ is set equal to $R_3$ for easier manipulation of the numbers. Voltage loop equations can thus be written as:

$$V_{out}=IR_2+V_{d1} \quad (2\text{-}1)$$

$$V_{out}=IR_2+IR_1+V_{d2} \quad (2\text{-}2)$$

Subtracting (2-2) from (2-1) yields $$IR_1=\Delta V_d=V_{d1}-V_{d2} \quad (2\text{-}3)$$

Solving for I in (2-3) and substituting for I in (2-2) yields $$V_{out}=\Delta V_d(R_2/R_1)+V_{d1}$$

$$V_{out}=(kT/q)ln(I_{s2}/I_{s1})(R_2/R_1)+V_{d1} \quad (2\text{-}4)$$

which can be easily compared to the original bandgap reference (1-1) above to see that the output of amplifier 217 is approximately equal to the bandgap reference voltage $V_{bg}$. For example, solving the above equations for $R_1$ and $R_2$ based on $V_{out}$=1.2 Volts, diode area ratio of 8:1 (selected to yield reproducible circuits having matched electrical and temperature characteristics), I=3 microAmperes, $V_1$=0.61 Volts, and kT/q=25.5 millivolts will yield approximately $R_2$=196.67 kiloOhms and $R_1$=17.675 kiloOhms. The gain factor A in (1-1), also referred to as the control loop gain, is nothing but $R_2/R_1$ which in this case turns out to be approximately 11.5.

When the above described bandgap reference circuit 200 is 5 manufactured using modern integrated circuit fabrication techniques, two practical issues arise. The first is the sensitivity of $V_{out}$ (output of amplifier 217) to input offset voltages required to balance $V_{out}$. Because of this, $V_{out}$ will not appear as exactly 1.20 volts in the manufactured circuit. The error will be proportional to the input offset voltage of amplifier 217 and the loop gain A. To eliminate such errors, an attempt can be made to reduce the variation in input offset voltages of manufactured amplifiers, thereby allowing a design correction to be made. Controlling variations in input offset voltage, however, is particularly difficult with amplifiers having metal oxide semiconductor (MOS) input transistors, as such devices have input offset voltages that vary appreciably across a given production lot.

The second practical issue concerning the above-described circuit 200 as well as any other bandgap reference circuit is the difficulty in repeatedly matching the characteristics of two resistors widely spaced in value to yield a ratio that is uniform across as many fabricated devices as possible. Although a matched resistor pair having a ratio of approximately 11 as computed above can be readily manufactured, lower ratios will typically yield more reproducible results. A reference circuit having resistors with lower ratios will be more reproducible and will exhibit smaller variations in its reference output.

SUMMARY

The invention presents a novel circuit for generating a bandgap reference signal by using area ratioed current mirrors to provide most of the needed loop gain. In addition, a diode voltage difference is generated that includes the effects of the area ratioed current mirrors.

DRAWINGS

Figure 6:
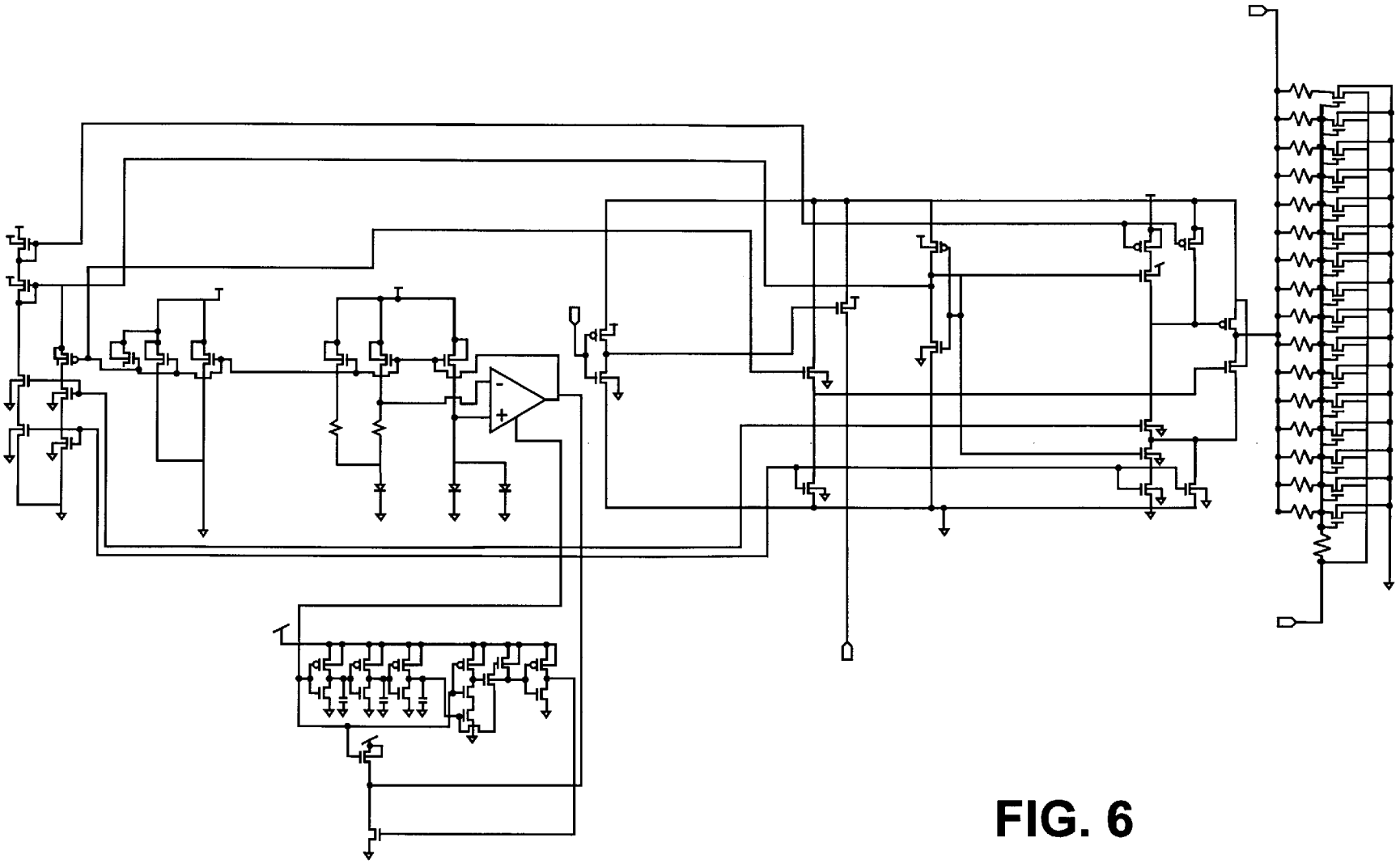
FIG. 6 is another embodiment of the invention.
Figure 7A:
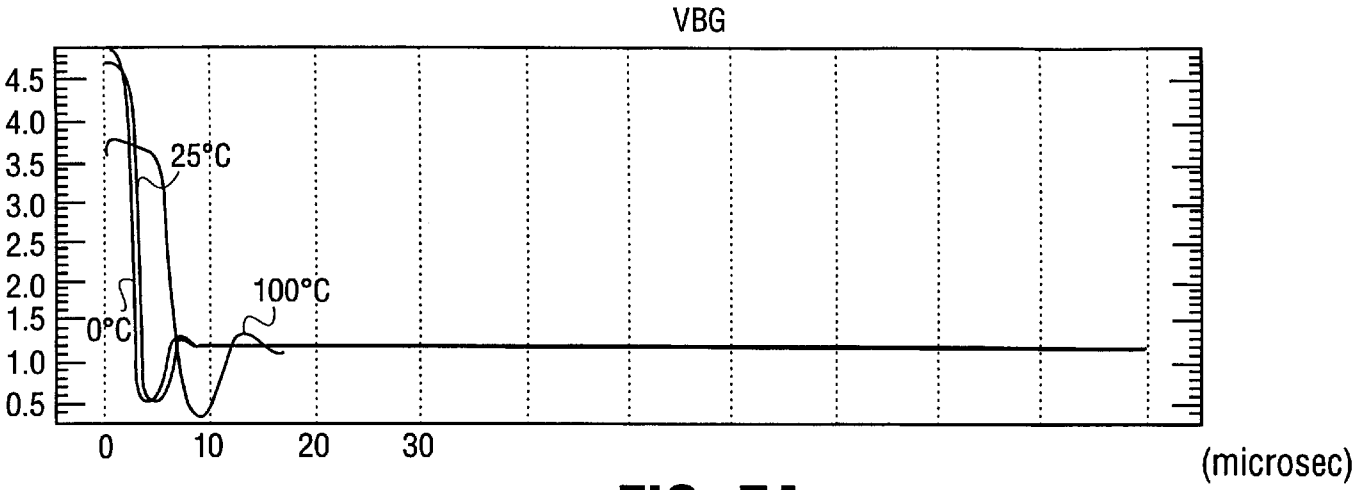
Figure 7B:
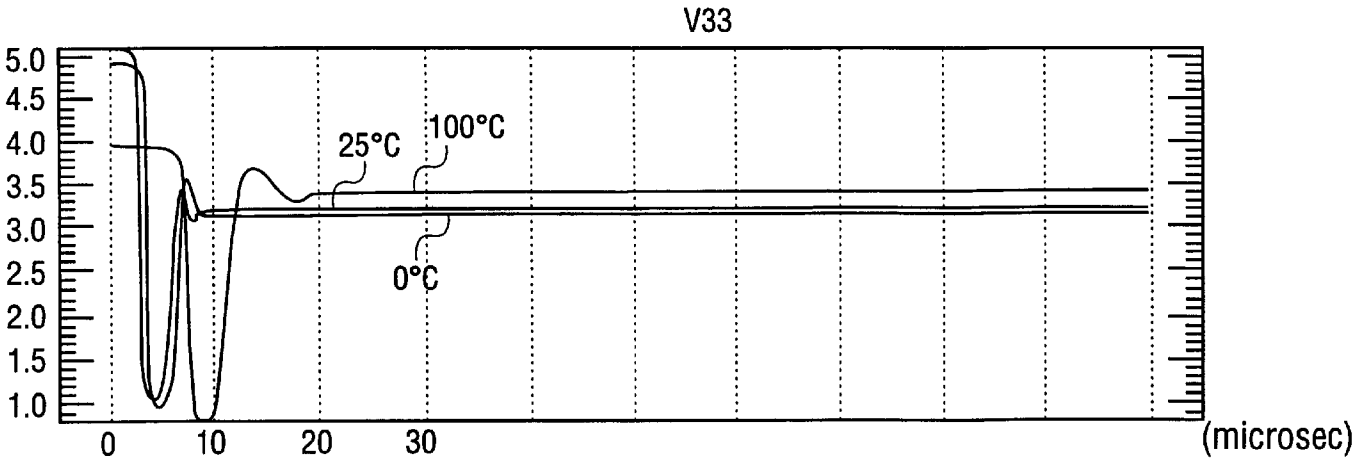
Figure 7C:
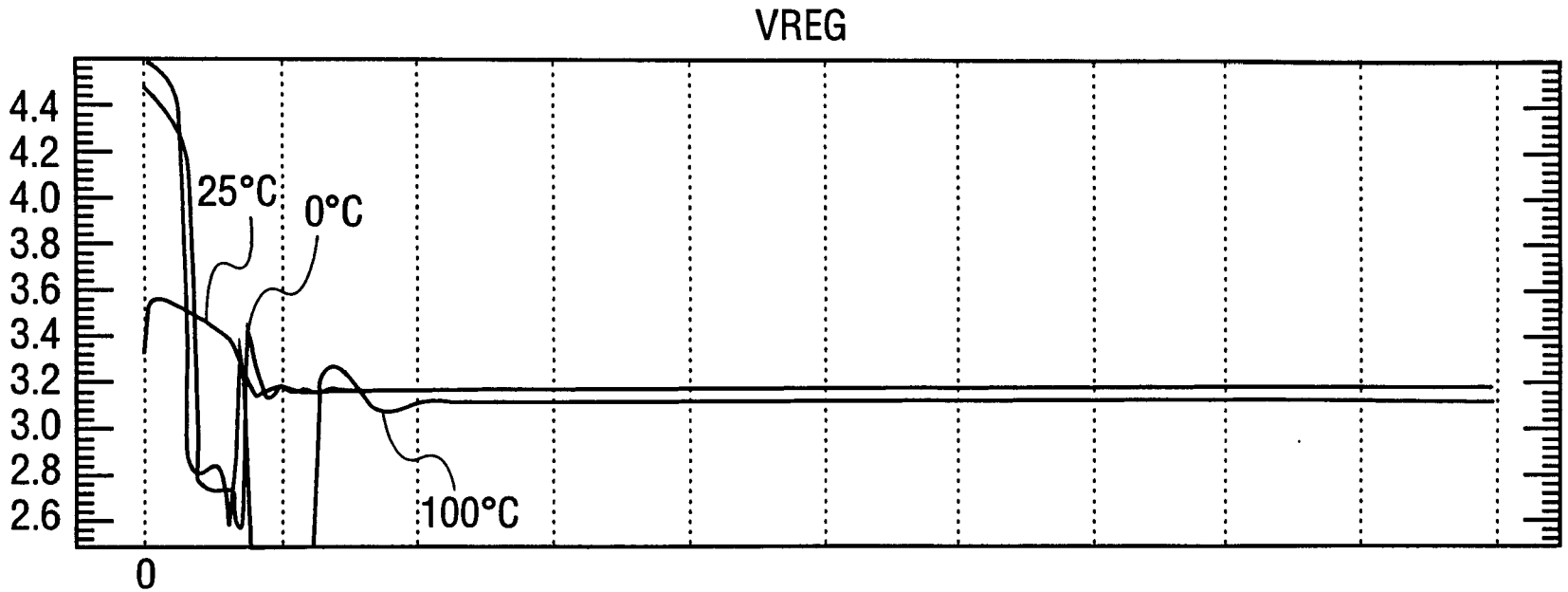

FIG. 7 includes simulated results from the embodiment of FIG. 6 and shows the recovery time response.

DETAILED DESCRIPTION

The following description of the invention will often refer to exact numerical values used in analyzing the invention. This is done solely to demonstrate the advantages of the invention over the prior art. The invention need not be limited to such exact values, as will be apparent to one reasonably skilled in the art.

In addition to the conventional area ratioed diodes (8:1), the invented bandgap reference circuit in one embodiment enjoys common centroid layout techniques that are further used to improve the manufacturing sensitivities. The embodiment uses 1 to 1 ratioed gain resistors and a common centroid 6:1 current mirror further improving manufacturing sensitivities. The proposed implementation also exhibits very fast turn on and recovery characteristics for low power and power down applications. All of the above techniques are fully compatible with standard digital CMOS fabrication processes.

Figure 1:
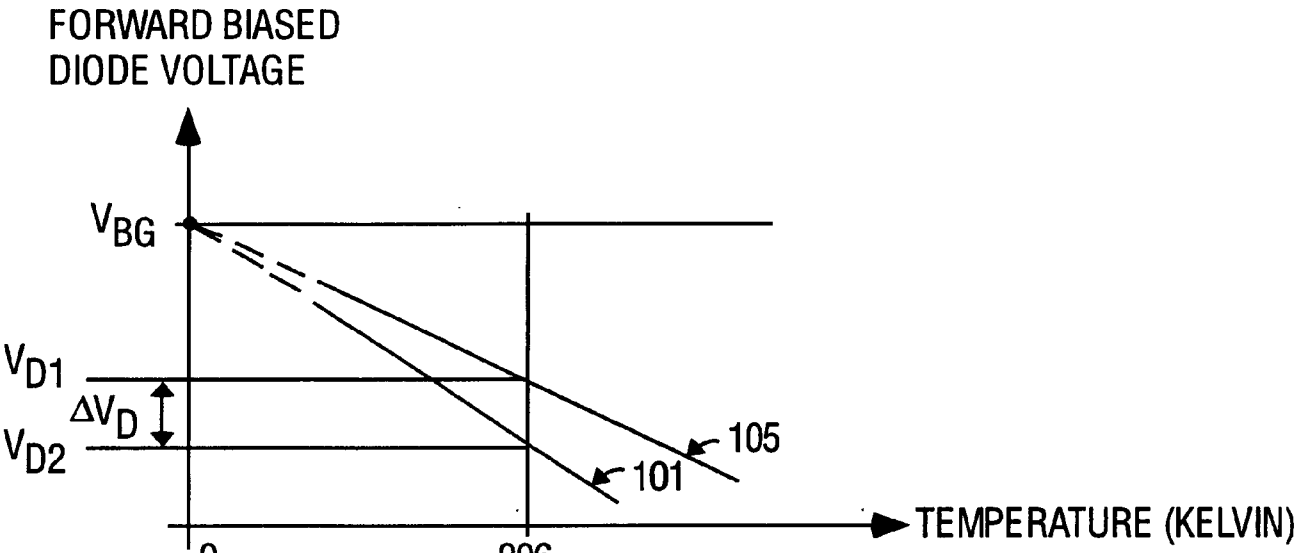
FIG. 1 (PRIOR ART)
FIG. 1 illustrates a plot of bandgap energy versus temperature.
Figure 2:
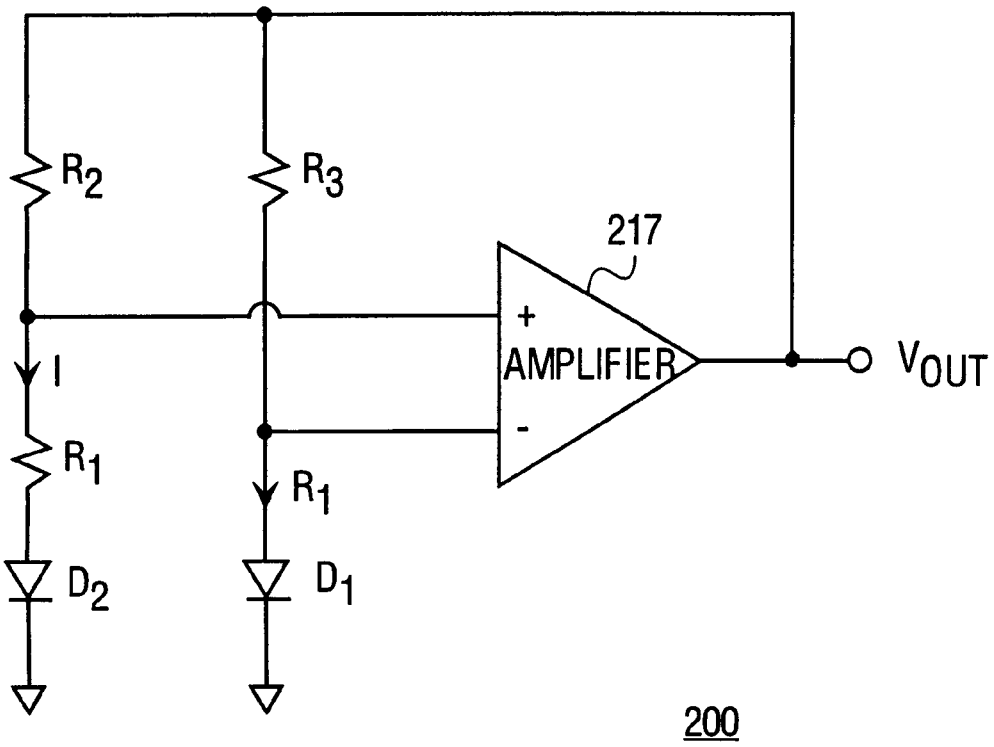
FIG. 2 (PRIOR ART)
FIG. 2 shows a prior art bandgap reference circuit.
Figure 3:
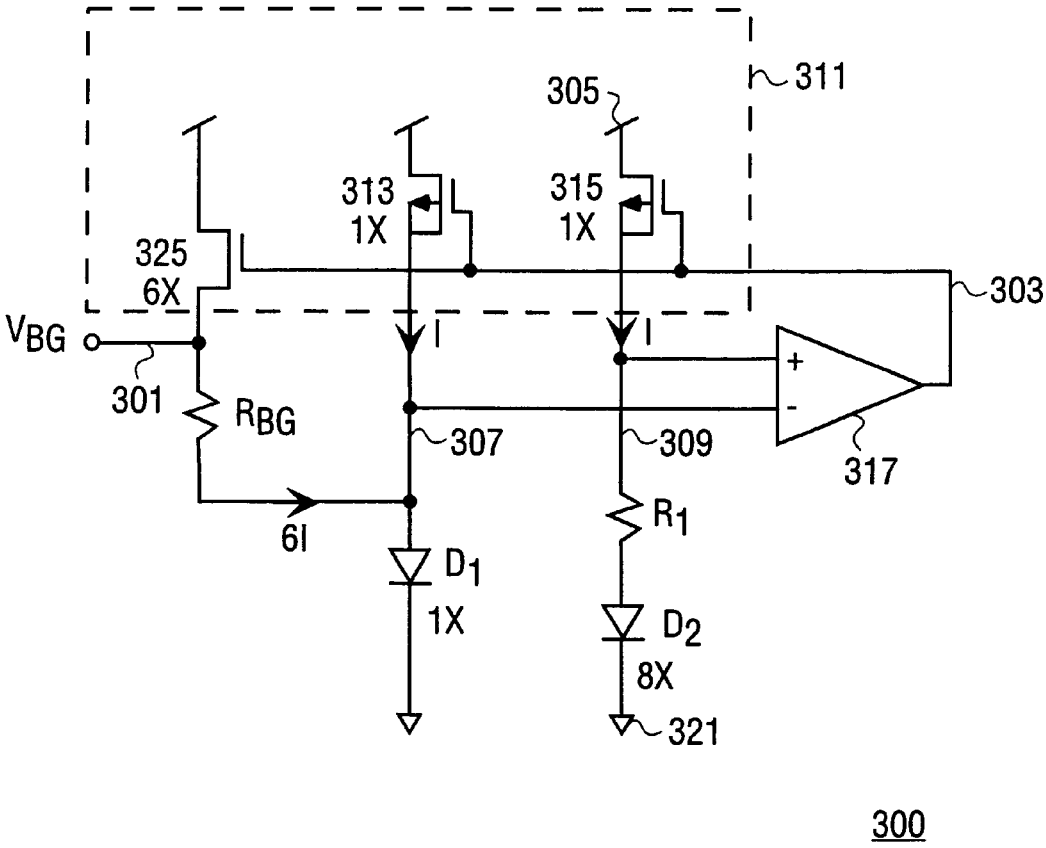
FIG. 3 illustrates an embodiment of the invention.

FIG. 3 illustrates a first embodiment of the invention. A reference circuit 300 is shown having an output node 301 presenting an output voltage $V_{bg}$ that remains substantially invariant with respect to temperature variations and limited variations in supply voltage at the supply node 305. To achieve $V_{bg}$, the circuit 300 incorporates current mirror subcircuit 311 controlled by amplifier 317. Amplifier 317 forces its two complementary input nodes 307 and 309 to approximately the same potential in the steady state. The amplifier does so by driving the current mirror subcircuit which in this embodiment is represented by the three p-channel MOS transistor elements 313, 315 and 325 whose gates are coupled to output 303 of the amplifier.

The two complementary input nodes 307 and 309 have diode-like elements D1 and D2 connecting them respectively to a common second supply node 321 as shown, with resistor $R_1$ in series with D2. Diodes D1 and D2 have geometries that define an area ratio typically greater than 1. In this embodiment, the D2:D1 area ratio is preferably 8:1 for practical reasons (common centroid), where D2 is actually eight separate smaller devices, each smaller device having the same geometry as D1 which is placed in the center of a 3×3 array. One skilled in the art will recognize that other ratios can also be used depending on the responsiveness and power consumption desired from the overall circuit 300.

Analysis of circuit 300 begins by making the following assumptions which will be used to calculate exemplary values for resistors $R_1$ and $R_{bg}$. Let the current sourced by elements 313 and 315 be I=3 microAmperes, and the current sourced by element 325 be several times larger. Such a current mirror scheme is substantially achieved by properly selecting the geometry of elements 313, 315, and 325. For example, the gate width-to-length (W/L) ratio of elements 313, 315, and 325 can be selected to yield an area W×L for element 325 six times that of the area for either element 313 or 315. Since all three elements 313, 315, and 325 are controlled at their respective gates by the same voltage at node 303, the trio acts as a set of current mirrors when balanced, i.e., when the amplifier and reference circuit form a closed loop which settles at one bias condition. The component values are selected in such a way as to have $V_{bg}$ equal to 1.2 Volts. The three generated currents of current mirror subcircuit 311 shown in FIG. 3 will track one another approximately in proportion to the area of each respective element, i.e., a 6:1:1 ratio.

Given the above assumptions and observations, the following voltage loop equations can be written based on circuit 300:

$$IR_1+V_{d2}=V_{d1} \tag{3-1}$$

$$V_{bg}=6IR_{bg}+V_{d1} \tag{3-2}$$

Solving for I in (3-1) and substituting for I in (3-2) gives $$V_{bg}=6\Delta V_d(R_{bg}/R_1)+V_{d1} \tag{3-3}$$

In circuit 300, $\Delta V_d$ is given by $$\Delta V_d=V_1-V_{d2}=kT/q[ln(7I/I_s)-ln(I/8I_s)] \tag{3-4}$$

Substituting (3-4) for $\Delta V_d$ in (3-3) gives $$V_{bg}=V_{d1}+6ln(56)\ kT/q[R_{bg}/R_1] \tag{3-5}$$

The use of ratioed current mirrors thus contributes significantly to the control loop gain A in circuit 300 as seen by the factor 6 in (3-5). This lessens the offset sensitivity of loop amplifier 317 in comparison with the prior art circuit 200 as the contribution to the required loop gain by amplifier 317 is decreased.

In addition, the combination of both current and diode area ratioing, represented by the factors 7 and 8, respectively, in (3-4), provides a larger $\Delta V_d$ than the prior art, thereby reducing circuit sensitivity to manufacturing errors in the resistor ratio $R_{bg}/R_1$. Incidentally, the factor 7 is due to the ratio 6:1 of the geometries of transistor elements 325 and 313, respectively.

The table below quantifies some of the advantages of the invention over the prior art bandgap circuit 200 described earlier based on a comparison of equations (3-3) and (3-4) with (2-4). The numbers for circuit 300 were obtained using $V_{bg}$=1.2 Volts, I=3 microAmperes, $V_{d1}$=0.61 Volts, and kT/q=25.5 milliVolts to give $R_1$=34.22 kiloOhms and $R_{bg}$=45.39 kiloOhms. Thus, the resistor ratio to be realized for the invention is approximately 1.3. These values result when the starting $I_s$ of diode $D_1$ is approximately $2\times10^{-16}$ Amperes. This value is a function of the manufacturing characteristics of the digital CMOS process as well as the diode size.

| Term in | Circuit Realization | |
|---|---|---|
| bandgap equation | Circuit 200 | Circuit 300 |
| A (gain factor) | $R_2/R_1 \sim 11.5$ | 6 $R_{bg}/R_1$ where $R_{bg}/R_1 \sim 1.3$ |
| $\Delta V_d$ | kT/q ln (8) | kT/q ln(56) |

By contributing to the gain factor A using the area ratios 6:1:1 in current mirror subcircuit 311, the invention yields a bandgap reference output $V_{bg}$ using a resistor ratio $R_{bg}/R_1$that is one order of magnitude smaller than the prior art. The actual implemented design used 37 kiloOhm resistors for $R_{bg}$ and $R_1$ ($R_1$=$R_{bg}$).

Moreover, the sensitivity of amplifier 317 to input offset voltages has been reduced by at least a factor of two over the prior art, because of a larger $\Delta V_{d1,2}$ term that was obtained by combining the diode area ratio 8:1 with the current area ratio 6:1:1 of the current mirror subcircuit 311.

The absolute geometries for elements 325, 313, and 325 in the invention's circuit 300 can be readily selected by one skilled in the art, so long as the trio exhibits an overall area ratio of M:1:1 where M is an integer selected to optimize device matching, power consumption, and manufacturing requirements for circuit 300. Using a ratio of 6:1:1 yields a more useful design from a fabrication standpoint, because the larger field effect transistor (FET) element 325 can be made up of integer units that are common centroided. Resistors $R_{bg}$ and $R_1$ can be formed as conventional well resistors, allowing circuit 300 to be readily implemented in conventional MOS, as well as deep submicron digital CMOS (Complementary MOS), fabrication processes.

The input offset requirements of amplifier 317 are not critical to successful operation of circuit 300 so long as the amplifier can sufficiently drive the p-channel elements 313, 315 and 325. An exemplary device for amplifier 317 can be a conventional, high open loop gain, MOS operational amplifier with complementary inputs, as illustrated in FIG. 4.

For fast response, amplifier 400 features a high gain folded cascode circuit designed using circuit elements that are available with a conventional digital CMOS fabrication process. The elements in FIG. 4 are described as MP for p-channel insulated-gate transistors, and MN for n-channel transistors (also characterized by an absence of the small circle on the gate). Their dimensions are given as gate width-to-length ratios as readily understood by one skilled in the art.

Figure 5A:
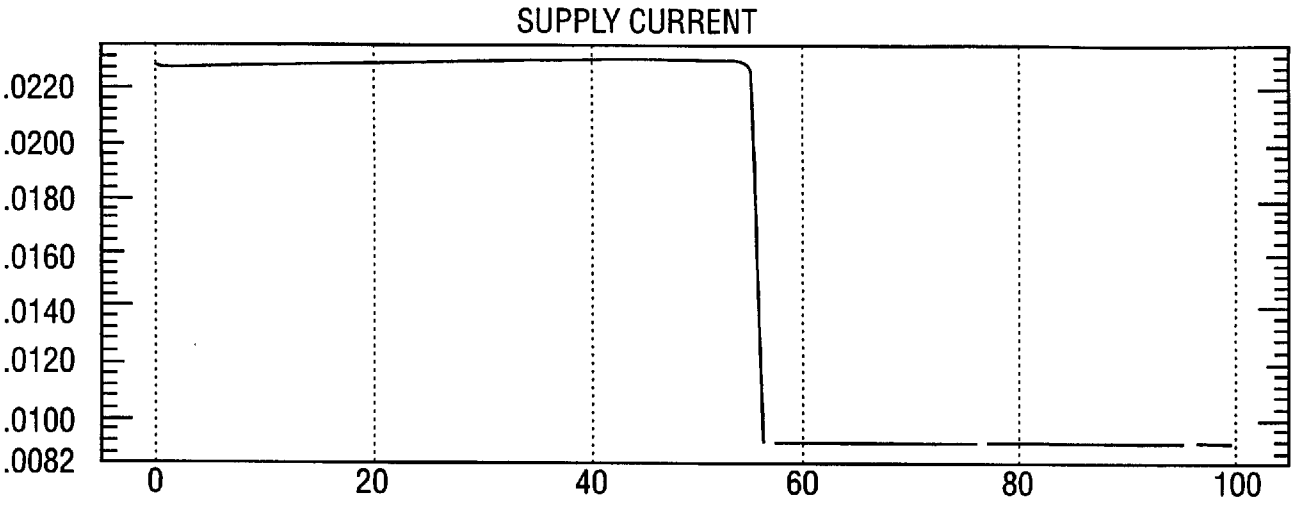
FIG. 5 shows the simulated characteristics of the amplifier of FIG. 4.
Figure 5B:
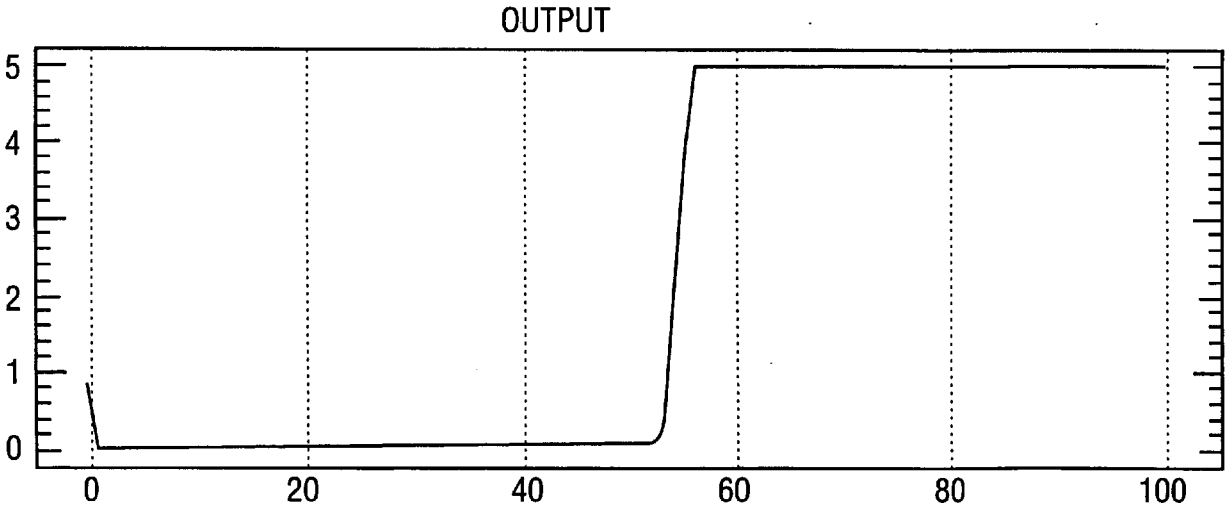
Figure 5C:
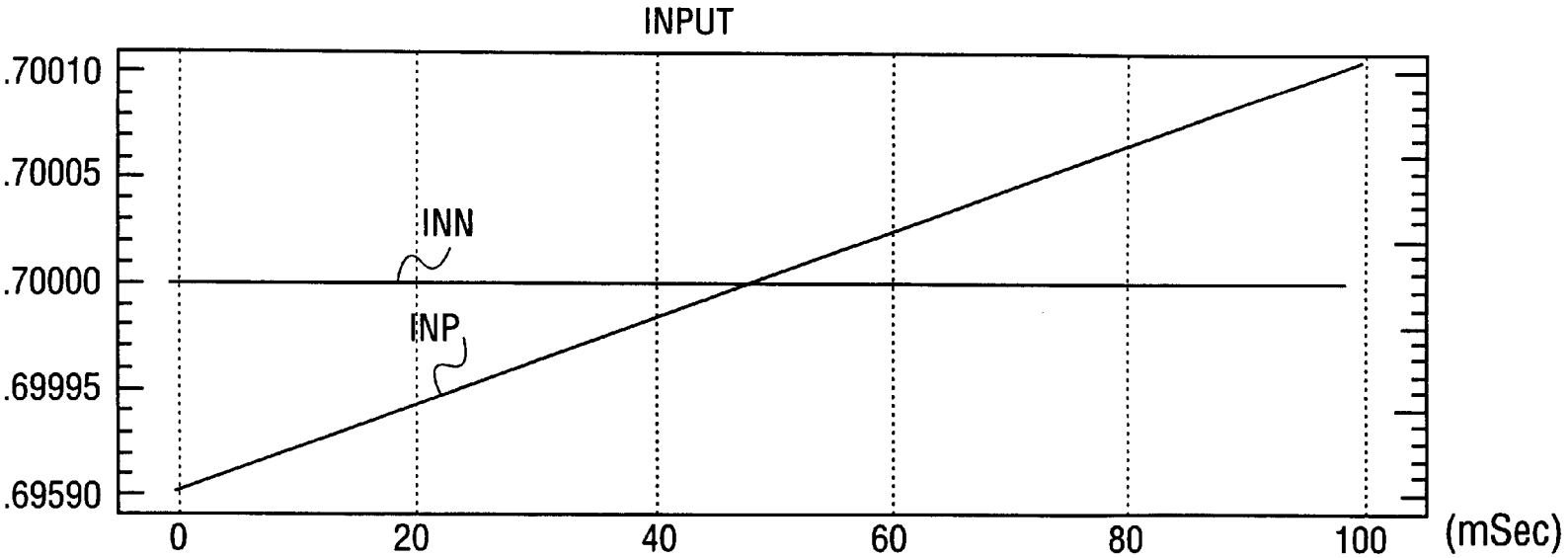

The amplifier 400 also features power down circuitry including MOS transistors MN10, MP7, and p-channel device formed near the well resistor having geometry 5/4000 micrometers. These three transistors are connected to an external enable signal EN. The power down circuitry helps eliminate floating nodes and current paths to ground. When the power down circuitry is not enabled, the supply current draw drops to zero for the entire amplifier 400, thus allowing the amplifier 400 to be used in low power bandgap reference circuits. The simulated performance of amplifier 400 appears in FIG. 5. FIGS. 5A–5C are self-explanatory to one reasonably skilled in the art.

Figure 4:
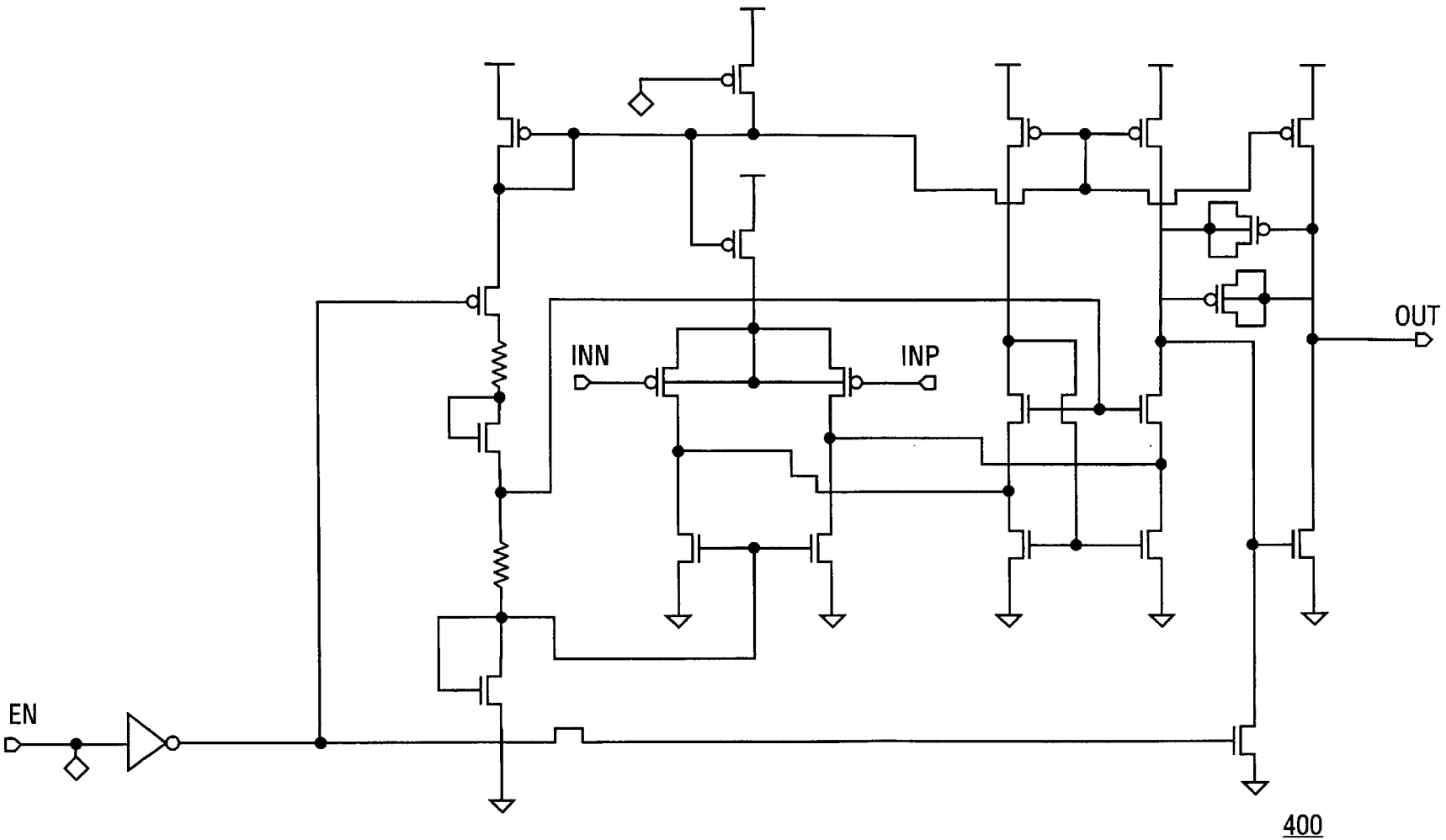
FIG. 4 shows a circuit schematic of an amplifier used in an embodiment of the invention.

For an embodiment of the bandgap circuit 300 in FIG. 6, simulation results have shown a power consumption of approximately 200 micro Watts using an amplifier 317 similar to amplifier 400 in FIG. 4 and a supply of approximately 5 Volts. Moreover, the design in FIG. 6 was also simulated at a supply of less than 2 Volts, such that a 100 microWatts version of the bandgap reference circuit 300 should also be possible using virtually the same design in FIG. 6.

The disadvantages of very low power implementations are the susceptibility to noise (due to higher impedance nodes) and slower output recovery times. A recovery time of less than 10 microseconds has been observed together with a power supply rejection ratio of approximately 45 decibels @ 1 MegaHz with an input supply of 4.5 to 5.5 Volts for a bandgap circuit consuming 2.5 milliwatts. The output reference displayed a temperature coefficient of less than 50 parts-per-million and an initial make tolerance of less than 1%. FIG. 7 shows some simulation results for recovery time ($V_{bg}$) at different temperatures for the circuit of FIG. 6.

The embodiments of the invention described above for exemplary purposes are, of course, subject to other variations in structure and implementation within the capabilities of one reasonably skilled in the art. As appreciated by those skilled in the art, analog circuit design often requires solving for a set of constraints, as described above. In so doing, however, trade offs must often be made between different performance specifications to solve related problems. For example, power consumption can be reduced at the expense of lower noise immunity and lower speed. Also, auto zero or chopper stabilized amplifiers could be used at the expense of added complexity which would provide additional improvement as would be obvious to one skilled in the art. In addition, the area ratios and the exemplary value for I=3 microAmperes discussed above can be altered by those skilled in the art to further fine tune the performance of the circuit. Such changes may be made without departing from the scope of the invention which is defined by the claims below.

What is claimed is:

1. A circuit for generating a reference signal, comprising:

first and second current sources having first and second transistors, respectively, that as connected can support different drain-source voltages, the first current source further defining an output node to yield said reference signal;

first diode element coupled to the output node of said first current source through a first resistor and defining a first diode voltage;

second diode element coupled to an output node of the second current source through a second resistor and defining a second diode voltage; and amplifier having inputs coupled to the first and second diode elements and an output coupled to control said first and second current sources in response to said first and second diode voltages.

2. A circuit as in claim 1:

wherein said reference signal is a linear combination of said first diode voltage and a difference of said first and second diode voltages.

3. A circuit as in claim 1 wherein;

said first and second resistive elements have a resistive ratio of approximately one.

4. A circuit as in claim 1 wherein a diode area ratio of the second diode to the first diode is greater than one.

5. A circuit as in claim 4 wherein said diode area ratio is approximately 8, said second diode element comprising eight devices each having a geometry substantially identical to said first diode element.

6. A circuit as in claim 1 wherein each of said first and second current sources comprises a p-channel MOS transistor with a source terminal shorted to a positive power supply node.

7. A circuit as in claim 1 wherein said first diode element is a diode-connected transistor.

8. A circuit as in claim 1 wherein said first and second current sources are connected to form a current mirror in which the first and second transistors define an area ratio, the first and second sources to generate first and second currents in proportion to said area ratio.

9. A circuit as in claim 8 wherein said area ratio of the first transistor to the second transistor is greater than one.

10. A circuit for generating a reference signal, comprising:

first and second diode elements defining first and second diode voltages and currents, the first and second diode elements having geometries that define a diode area ratio of the second diode element to the first diode element greater than one;

current mirror coupled to said first and second diode elements and generating said first and second diode currents, the current mirror comprising a pair of transistor elements having geometries that define a current area ratio greater than one;

means for providing a difference between said first and second diode voltages, said difference being logarithmically proportional to said current and diode area ratios; and means for providing said reference signal as a linear combination of said first diode voltage and said difference.

11. A circuit as in claim 10 wherein said means for providing the difference and the reference signal include first and second resistive elements coupled between the current mirror and the first and second diode elements to conduct at least some of the first and second currents in said first and second diode elements, respectively, said reference signal further being proportional to a ratio of the resistive values of said resistive elements.

12. A circuit as in claim 11 wherein the resistive elements are well resistors formed using a CMOS fabrication process.

13. A circuit as in claim 10 wherein each of said pair of elements in the current mirror comprises a p-channel MOS transistor with a source terminal shorted to a positive power supply node.

14. A circuit as in claim 10 wherein the current mirror further comprises a third transistor element coupled to provide a third mirrored current into the first diode element in addition to the first diode current.

15. A circuit in claim 14 wherein the first, second and third transistor elements have a current area ratio of 6:1:1.

* * * * *

UNITED STATES PATENT AND TRADEMARK OFFICE

CERTIFICATE OF CORRECTION

PATENT NO. : 6,075,407
DATED : June 13, 2000
INVENTOR(S) : Doyle

It is certified that error appears in the above-identified patent and that said Letters Patent is hereby corrected as shown below:

Column 2,
Line 60, delete "$V_1$=0.61" and insert -- $V_{dl}$=0.61 --.
Line 67, delete "is 5 manufactured" and insert -- is manufactured --.

Signed and Sealed this

Twenty-eighth Day of January, 2003

JAMES E. ROGAN
*Director of the United States Patent and Trademark Office*